US006520377B2

(12) United States Patent
Yquel

(10) Patent No.: US 6,520,377 B2
(45) Date of Patent: Feb. 18, 2003

(54) DISPENSER FOR SELECTIVELY DISPENSING SEPARATELY STORED COMPONENTS

(75) Inventor: Jean-Pierre Yquel, Colombes (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/773,694

(22) Filed: Feb. 2, 2001

(65) Prior Publication Data

US 2001/0027981 A1 Oct. 11, 2001

(30) Foreign Application Priority Data

Feb. 4, 2000 (FR) ..... 00 01451

(51) Int. Cl.[7] ..... B65D 83/14

(52) U.S. Cl. ..... 222/1; 222/144.5; 222/145.2; 222/148; 222/402.18; 222/136

(58) Field of Search ..... 222/136, 144.5, 222/145.2, 94, 148, 402.18, 1

(56) References Cited

U.S. PATENT DOCUMENTS

| | | | | |
|---|---|---|---|---|
| 3,326,416 A | | 6/1967 | Hayes | |
| 3,525,997 A | | 8/1970 | O'Donnell | |
| 3,543,965 A | | 12/1970 | Lehmann | |
| 3,568,888 A | | 3/1971 | Baldoni et al. | |
| 3,592,361 A | * | 7/1971 | Marand | 222/136 |
| 3,612,361 A | * | 10/1971 | Ewald et al. | 222/136 |
| 3,642,173 A | * | 2/1972 | Marraffino | 222/136 |
| 3,720,376 A | * | 3/1973 | Morane et al. | 222/402.18 |
| 3,770,165 A | * | 11/1973 | Steiman et al. | 222/136 |
| 3,796,352 A | | 3/1974 | Morane | |
| 3,894,659 A | * | 7/1975 | Focht | 222/136 |
| 3,976,223 A | | 8/1976 | Jass et al. | |
| 4,431,119 A | * | 2/1984 | Stoody | 222/129 |
| 4,969,584 A | | 11/1990 | Joulia | |
| 5,167,347 A | * | 12/1992 | Wiegner et al. | 222/136 |
| 5,695,096 A | | 12/1997 | Yquel | |

FOREIGN PATENT DOCUMENTS

| | | |
|---|---|---|
| DE | 29 16 699 | 11/1979 |
| EP | 0 709 305 | 3/1996 |
| FR | 2 133 112 | 11/1972 |
| FR | 2 637 870 | 4/1990 |
| FR | 2 679 880 | 2/1993 |

OTHER PUBLICATIONS

English language Derwent Abstract of DE 29 16 699.
English language Derwent Abstract of FR 2 679 880.

* cited by examiner

*Primary Examiner*—Lesley D. Morris
*Assistant Examiner*—Stephanie L. Willatt
(74) *Attorney, Agent, or Firm*—Finnegan, Henderson, Farabow, Garrett & Dunner, L.L.P.

(57) ABSTRACT

A dispenser for separately packing at least two components and allowing the selective dispensing of either component or both components together via a propellant gas is provided. The dispenser includes a rigid outer vessel and an inner container arranged inside the outer vessel. The outer vessel contains one component, the inner container contains the other component and the propellant gas is arranged in at least the outer vessel. A dispensing valve is configured to be placed in selective communication with the outer vessel, the inner container, or both the outer vessel and inner container, for example, via first and/or second feed orifices, and communicates with a dispensing path. A valve actuator is provided, the dispenser being capable, when the dispensing valve is in communication with the rigid outer vessel, of dispensing substantially only propellant gas so as to clean out the dispensing path.

56 Claims, 6 Drawing Sheets

DISPENSER FOR SELECTIVELY DISPENSING SEPARATELY STORED COMPONENTS

The present invention relates to a method for dispensing two components, particularly liquid components, using a propellant gas, the components being packaged separately from one another in the same dispenser. The invention also relates to a dispenser for allowing the selective dispensing of the components.

More specifically, the dispenser according to the invention is of the "aerosol can" type equipped with a dispensing valve that can be actuated using a push-button and equipped with a dispensing system. Customarily, a push-button such as this includes a dispensing orifice via which the component (or components) leaves the can, under the thrust of the propellant gas. The valve with which the present invention is concerned is of the dual feed type, each feed route being in communication with a reservoir, each of which contains one of the components. In particular, the invention is concerned with the dispensing of these components, not only in the form of a mixture but also, as desired, individually. The invention in particular envisages cleaning out the dispensing system using the propellant gas before or after each use.

So, one aspect of the present invention is to provide a dispenser which allows the selective dispensing of either one of the components in isolation or in a mixture of the components. Another aspect of the invention is to provide a dispenser which allows the dispensing system to be cleaned out automatically or at will before or after each use.

The dispenser of the invention can be used for dispensing products of different kinds, for example cosmetic or dermo-pharmaceutical products, household, technical, horticultural products, etc.

In general, in multi-component products that are to be stored separately and mixed at the time of use, a chemical reaction takes place between the components. Now, when a mixture of the components remains at rest in the dispenser system, even after a relatively short period of time, residues form and block the dispensing system. Thereafter, any subsequent dispensing becomes impossible. This phenomenon is highly pronounced when the product is, for example, a two-part adhesive, one of the components of which contains a monomer and the other a polymerization catalyst. The dispensing of a two-component product in the form of a mixture contained in a mixing dispenser is widely known.

Thus, document DE-A-29 16 699 describes a dispenser containing a product with two liquid components, contained separately in a common can and pressurized using a propellant gas. The can is equipped with a mixing valve with two feed routes. A first feed route of the valve is in communication with a flexible pouch placed inside the can and filled with a first component. The second feed route of the valve communicates with a volume formed between the interior wall of the can and the external wall of the pouch. Packaged together in this volume are the second product and the propellant gas. This dispenser makes it possible, when the dispensing valve is actuated, to dispense a mixture of the two components.

A shaving cream dispenser which allows two liquids, initially separate, to be mixed in a mixing valve leading to the heating of the cream, is described in document U.S. Pat. No. 3,326,416. One of the liquids may be hydrogen peroxide and the other may contain a hypophosphite. The reaction of these liquids causes an exothermal breakdown of the liquids, supplying heat to foaming components and making it possible to dispense a warm foaming mixture.

A dispenser capable of containing several components is described in document FR-A-2 133 112. A dispensing valve that can be actuated by a push-button is designed to selectively dispense one of the components or a mixture of various components. The valve, as described, is not designed to clean out the dispensing system using a propellant gas before or after use. In addition, such a valve cannot be produced on an industrial scale. This is because, depending on the number of components to be dispensed, a number of inlet chambers are stacked up in this valve, each chamber having a sealing means through which a common nozzle passes. This document does not describe in detail how each inlet chamber is placed in communication with a corresponding reservoir respectively containing one of the components, nor how these reservoirs are arranged in a common external body and pressurized using the propellant gas. This dispenser attempts to avoid the blocking of the valve but does not in any case prevent the blocking of the dispensing system, nor does it envisage cleaning out the dispensing system using the propellant gas.

Document EP-A-0 709 305 describes a dispenser comprising a dispensing valve for a single product that is to be dispensed in the form of a spray or mousse or foam, using a propellant gas, the valve being equipped with an additional gas intake orifice and with a nozzle carrying a moving seal which, in a position of rest, seals off the additional gas intake orifice. The nozzle, when pushed partially in, moves the seal into a position in which it uncovers the additional gas intake orifice, and gas is sent into the dispensing system to clean it out. The nozzle, when it is pushed fully in, positions the moving seal in an area where a longitudinal and/or circular groove made in the internal wall of the valve body allows product to be let in. Thus, a product/gas mixture is dispensed. This dispenser is not designed for dispensing two products or for mixing two products.

Another source, document U.S. Pat. No. 3,568,888, discloses a dispenser containing, separately, two liquids. This dispenser is equipped with a selective dispensing system allowing the dispensing of either one of the liquids alone or of a mixture of the two liquids. This dispenser exhibits several drawbacks.

Specifically, this dispensing system entails three-position actuation, two of which are to be provided in a position somewhere between the position of rest and the fully pushed-in position. Such actuation is difficult for the user to achieve because the two intermediate positions are difficult to identify. Hence, when the user's finger, pressing on the pushbutton, moves during dispensing, particularly during prolonged dispensing action, a change in the composition of the product may occur in the course of dispensing, and this may have disastrous consequences.

In addition, the dispensing system consists of a valve of complex and bulky construction occupying a great deal of volume inside the dispenser, which volume it would be desirable to fill with product and/or, in particular, with propellant gas. Furthermore, in this valve, in order to guarantee reliable operation, it is necessary to provide sealing in four places: a) at the place where the valve stem emerges to the outside of the valve body; b) at the inlet of the first liquid to the valve body; c) at the inlet of the second liquid to the valve body; and d) between a flange on the stem and the internal wall of the valve body.

Developing a valve thus configured is one of the trickiest of tasks. What is more, in certain regions inside the valve body, for example below the flange, product residue may build up, carrying the risk of impeding the correct operation of the valve or even of causing the valve to stick.

The invention sets out to overcome at least one of the above drawbacks by providing a dispensing unit comprising a valve of at least one of relatively simple construction, relatively easy to use and relatively reliable in operation, allowing the user to choose one of several methods of dispensing a multi-component product.

Another aspect of the invention involves providing a dispensing unit whose valve construction makes it possible to remove product residue built up in the valve body and/or to prevent the formation of such residue. Yet another aspect of the invention is to equip this dispensing unit with a valve of little bulk so that maximum volume is available for the storage of the product and/or the propellant gas.

Thus, the subject of the invention is a dispenser for separately packaging at least two components, particularly liquid components, comprising:

a) a rigid outer vessel and an inner container arranged inside the outer vessel, the outer vessel containing one component, the inner container containing another component, a propellant gas being present at least in the outer vessel;

b) a push-in dispensing valve, comprising a body capable of being placed selectively in communication with the outer vessel, the inner container, both vessels, via first and/or second feed orifices respectively so as, via a dispensing path, to allow one or the other of the components or a mixture of both to be dispensed;

c) an actuator for actuation of the valve; the dispenser being capable, when the dispensing valve is in communication with the rigid outer vessel, of dispensing substantially only propellant gas so as to clean out the dispensing path, the dispensing of the mixture of components occurring in response to the actuator being pushed fully in.

As a preference, the dispensing valve has a single body defining an inner chamber.

The fact that the "mixture of components" mode occurs at the end of travel of the actuator has the advantage that the mixture of the components is formed in the upper part of the valve chamber and more specifically when the valve chamber is at its maximum volume, above the seal, so that the mixing of the components occurs optimally.

The propellant gas may preferably be chosen, in the conventional way, from one of liquefiable hydrocarbons, hydrofluorocarbons, chlorofluorocarbons, nitrogen, carbon dioxide, dimethyl ether, nitrogen monoxide, compressed air and a mixture of these gases.

According to one embodiment, the inner container may be a supple reservoir formed, for example, of a flexible, compressible pouch or of a concertina container. Any other contractible container capable of isolating the first component from the second can be used as an alternative. In other words, such an inner container is capable of decreasing in volume as the component it contains is gradually used up in response to the pressure exerted by propellant gas arranged in the outer vessel.

According to a first embodiment, whereby the mixture of the components is dispensed in the "head-up" position, a dip tube is provided. This is connected to the second feed orifice of the valve and extends more or less to the bottom of the outer container. This connection may advantageously be made via a fitting ring mounted, for example, by clamping onto the valve body and comprising a portion which engages with one end of the dip tube.

According to an advantageous feature of the invention, the actuator can move between a position of rest, in which the internal valve chamber is isolated from the outside, and first and second actuated positions so that, in the first actuated position the chamber is in communication with the first orifice, and in the second actuated position the chamber is in communication with the first and the second orifice, the first actuated position resulting from the actuator being partially depressed and the second actuated position resulting from the actuator being fully depressed.

Thus, to clean out the dispensing path, the user has just one intermediate position to identify, this being between the position of rest and the fully depressed position, which offers a considerable advantage over the dispenser described in the aforementioned document U.S. Pat. No. 3,568,888.

According to an advantageous embodiment, the inner container, in communication with the first feed orifice, is located practically in alignment with the valve body.

Advantageously, the dispensing valve actuator comprises an elastic seal dividing the valve chamber into two parts, a first part being in communication with the first feed orifice and a second part being in communication with the second feed orifice, there being a passage to establish communication between the first and second parts of the chamber when the actuator is pushed fully in. Furthermore, when the valve is actuated, the second part of the valve chamber is in communication with the dispensing path.

This arrangement has the advantage that the two valve feed orifices can be located at a determined axial distance so that the components are mixed only in the second part of the valve chamber. This part of the chamber can easily be cleaned out and can be cleaned out so fully so as to either prevent the formation of dry residue or eject such dry residue formed by the reaction of the components of the mixture during an earlier dispensing operation.

Advantageously, the axial level of the seal is chosen so that when the valve is in the closed position the second part of the valve chamber has a minimum or even practically zero volume. Through this contrivance, the amount of product residue after dispensing can be minimized. In this valve-closed position, the seal block off the second feed orifice.

Advantageously also, the axial level of the second feed orifice is chosen so that when the valve is in the first position, that is to say more specifically in the cleaning-out position, the second part of the valve chamber has as small a volume as possible. Also, as a preference, the second orifice is made in the second part of the valve chamber near to the opposite end to the first feed orifice. This contrivance allows the cleaning-out operation to be carried out under optimum conditions.

The passage between the two parts of the chamber may be formed by at least one longitudinal and/or circular groove made in an internal wall of the valve body. When the actuator is fully depressed, this passage is open on each side of the seal into the first and second parts of the valve chamber.

Advantageously, the seal is an annular seal. The annular seal may be an attached annular seal, for example made of elastomeric material such as Buna N- or Neoprene. This seal is fixed to a periphery of the actuator and is able to slide in sealed contact with the internal wall of the valve body, on each side of the passage.

According to one embodiment, the annular seal is an O-ring, but other appropriate forms may be envisaged. This annular seal may also be in the form of a cylindrical bulge molded integrally with the actuator.

Advantageously, there is an elastic return for closing the valve when the valve is in the position of rest and when depressed in the actuated position, allowing selective dispensing of the components. This elastic return is advantageously formed of a helical spring resting axially against one end of the nozzle and preferably made of metal.

In the customary way, operating element is provided for actuating the valve. Advantageously, this comprises a push-button through which there passes a discharge passage constituting part of the dispensing path which opens to a nozzle element equipped with a dispensing orifice.

According to another embodiment, the internal container is rigid and non-compressible. In this case, the container contains, apart from the first component, a propellant gas. There is a dip tube for extending the first feed orifice more or less to the bottom of the inner container. In this case, exclusively "head-up" use is recommended. The dispensing path is cleaned out in this case in the "head-down" position by partially depressing the actuator.

According to yet another embodiment, neither the first nor the second feed orifice is provided with a dip tube. In this case, the second component or a mixture of the components is dispensed in the "head-down" position. The dispensing path is cleaned out in this case in the "head-up" position by partially depressing the actuator.

One advantage that this valve exhibits lies in the fact that there is no communication between the first and second feed orifices during the storage period. The second component cannot therefore enter the inner container at an inopportune moment and possibly react with the first components, and vice versa.

The invention also relates to a method for the selective dispensing of the components contained in the dispenser which has just been described.

According to a first embodiment of the dispensing method, use is made of a dispenser wherein the second orifice is equipped with a dip tube as described previously, which dip tube communicates with the second component. The second component is pressurized directly using the propellant gas. The first component is packaged in the inner container which is of compressible and/or contractible nature.

This method makes it possible, selectively, to dispense either one or the other of the two components or to dispense a mixture thereof.

This method comprises partially depressing the nozzle to dispense the second component with added propellant gas, with the dispenser in the "head-up" position; fully depressing the nozzle in the "head-up" position to dispense a mixture of the components; fully depressing the nozzle to dispense the first component alone in the "head-down" position; and partially depressing the nozzle in the "head-down" position to clean out the dispensing path.

According to a second embodiment of the dispensing method, use is made of a dispenser wherein the second orifice has no dip tube but communicates with the second component. The second component is pressurized directly using the propellant gas. The first component is packaged in the inner container which is of compressible or contractible nature. This method allows selective dispensing of either one or the other of the two components or a mixture thereof. This method comprises partially depressing the nozzle to dispense the second component alone with the dispenser in the "head-down" position; fully depressing the nozzle to dispense a mixture of the components in the "head-down" position; fully depressing the nozzle to dispense the first component with added propellant gas in the "head-up" position; and partially depressing the nozzle in the "head-up" position, to clean out the dispensing path.

According to another aspect of the invention, a dispenser for selectively dispensing at least two components, singularly and in combination is provided. The dispenser comprises an outer container and an inner container arranged inside the outer container, a first component contained in the inner container and a second component separated from the first component and contained in the outer container, a gas propellant contained in at least the outer container, a dispensing valve having a body configured to be placed in selective communication with at least one of the inner and outer containers so as to dispense at least one of the first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components.

According to yet another aspect of the invention, a method for selectively dispensing components contained in a dispenser is provided. The method comprises providing a dispenser comprising an outer container and an inner container arranged inside the outer container, a first component contained in the inner container and a second component separated from the first component and contained in the outer container, a gas propellant contained in at least the outer container, a dispensing valve having a body configured to be placed in selective communication with at least one of the inner and outer containers so as to dispense at least one of the first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components, holding the dispenser in a head-up dispensing position, and depressing the actuator to the first actuation position to dispense substantially only the gas propellant from the outer container.

According to a further aspect of the invention, a method of cleaning out a dispensing path of a dispenser is provided. The method comprises providing a dispenser comprising an outer container and an inner container arranged inside the outer container, a first component contained in the inner container and a second component separated from the first component and contained in the outer container, a gas propellant contained in at least the outer container, a dispensing valve having a body configured to be placed in selective communication with at least one of the inner and outer containers so as to dispense at least one of the first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components, orienting the dispenser to provide communication between the gas in the outer container and a second feed orifice, and depressing the actuator to provide communication between the second feed orifice and the dispensing path to dispense substantially only gas from the outer container.

By way of non-limiting examples, mention may be made of the following pairs of components which can be packaged, one separate from the other, in the dispenser of the invention: a pair of two scents, a sunscreen and an after-sun product, two hair colorants of different shades, two vitamins or two other cosmetic or dermo-pharmaceutical active ingredients, a foundation and a moisturizer, a deodorant and an anti-perspirant, a hair conditioner and a coating, a permanent wave made up of a reducing component and a fixing component, a hair dye made up of an oxidizing agent and a colorant, a two-part adhesive comprising a monomer and a catalyst, etc.

In certain instances, for example when one of the components is corrosive or an irritant, use may be made of a system for immobilizing the operating means, preventing this component from being dispensed by itself. Such systems may prevent the actuation of the valve either in the "head-up" position or in the "head-down" position. Immobilizing systems that can be used in the context of the present invention are described for example, in documents FR-A-2 637 870 and FR-A-2 679 880 in the name of the applicant company.

Apart from the provisions set out hereinabove, the invention includes in a certain number of other provisions which will be dealt with more fully hereinafter with regard to some exemplary embodiments which are described with reference to the appended drawings but which are not in any way limiting. In the drawings, FIG. 1*a* is a cross-sectional view of a first embodiment of a dispenser according to the invention, in the "head-up" position of use;

FIG. 1*b* is a cross-sectional view of the dispenser of FIG. 1*a* in the "head-down" position of use, for dispensing a first component alone;

Figure 1A:
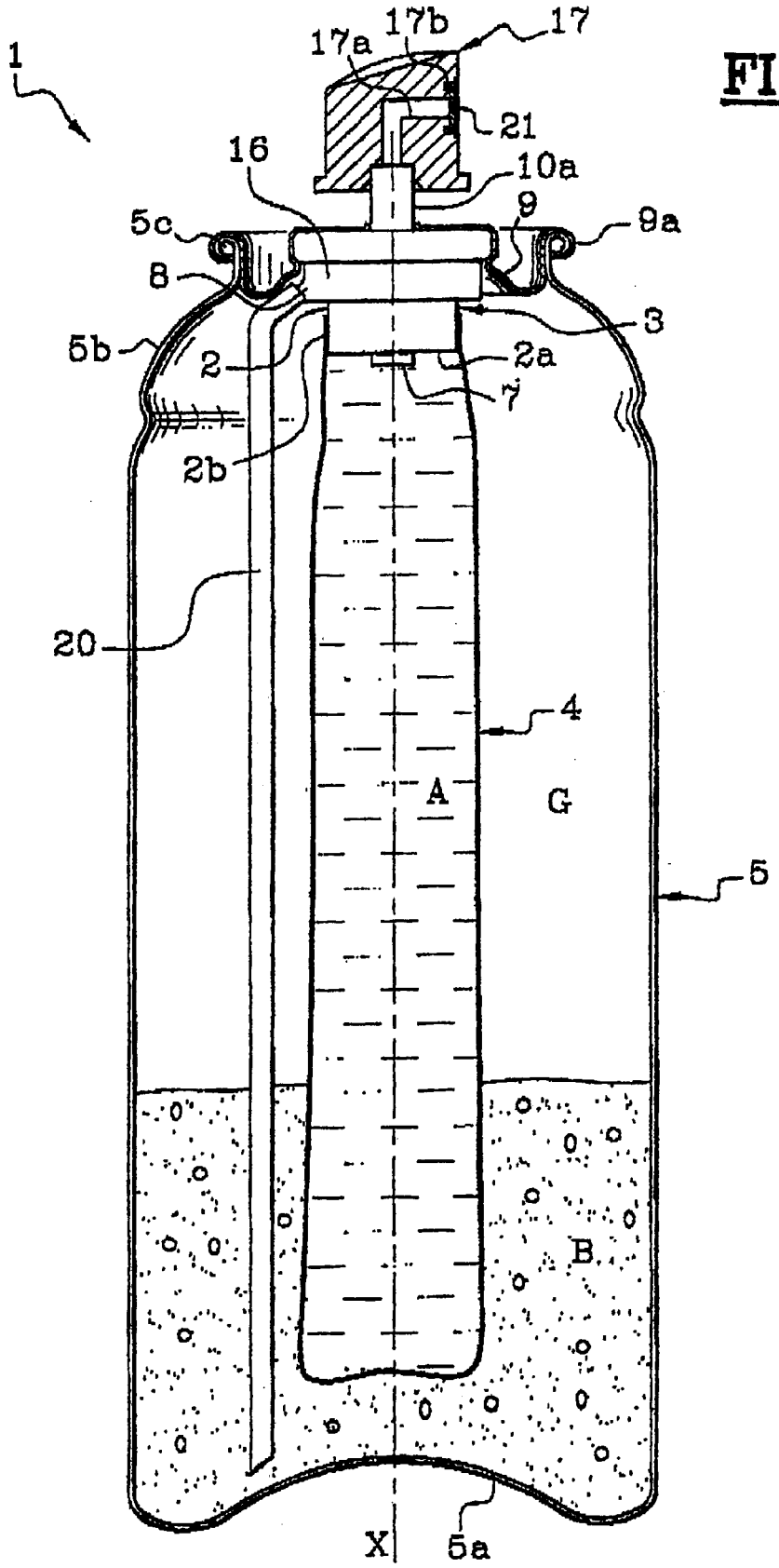

With reference to the appended FIGS. 1*a,* 1*b,* and 2–4, the reference numeral 1 has been used to denote a dispenser according to a first embodiment of the invention depicted, in to FIG. 1*a,* in the "head-up" position. The dispenser 1 is intended for the packaging of two liquid components A, B and for the selective dispensing of either one of the components, A or B, by itself or in a mixture of the two components A, B using a propellant gas G.

The dispenser 1 comprises an outer container 5 of longitudinal axis X of the "aerosol can" type, of cylindrical overall shape and comprising a closed bottom 5*a*. The outer container 5 has a dome-shaped upper part 5*b* capped with a valve-holder dish 9 in which the body 2 of a dispensing valve 3 is mounted, for example by expansion rolling. Advantageously, the valve-holder dish 9 is made of metal. It is fixed to the dome 5*b* of the outer container by a rolled edge 5*c*, 9*a*.

The valve 3 comprises, on the inside, a chamber 6 in which an actuator or nozzle 10 is mounted so that it can move. The nozzle comprises a hollow stem portion 10*a* which has a dispensing duct 15 (see FIGS. 2–4). This stem emerges to the outside of the outer container 5 and is intended for the mounting of a push-button 17. This push-button, designed as a means of operating the valve 3, comprises a product-dispensing duct 17*a* of elbowed or "L" shape. The duct 17*a* opens to a nozzle element 17*b* equipped with a dispensing orifice 21.

The nozzle 10 comprises a portion 10*c* of a diameter slightly smaller than the inside diameter of the valve body and designed to slide axially therein. The portion 10*c* is equipped with annular seal 11 capable of pressing in a sealed manner against the internal wall of the valve body 2. Advantageously, the seal is formed of a mobile annular seal 11, particularly an O-ring, preferably made of an elastomeric material. However, it is possible to produce an annular bulge by injection over molding with an appropriate material, for example a thermoplastic elastomer, over the periphery of the portion 10*c* of the nozzle 10. The annular seal or the bulge 11 advantageously has a height greater than the diameter of the orifice 8.

Alternatively, this annular seal or this bulge could be located, when the valve is in the position of rest, below the orifice 8 and above a product feed passage 14. This passage 14 is made in the internal wall of the valve body 2. For this purpose, the valve body 2 comprises at least one longitudinal and/or circular groove 14, the purpose of which will be explained later on during the description of the operation of the valve. It is to be noted that the height of the groove is greater than the thickness of the seal 11.

The valve body 2 comprises an end wall 2*a* equipped with a first feed orifice 7. The valve body 2 is connected on a lateral portion 2*b*, in a sealed manner, to an inner container 4. Hence, the inner container 4 communicates with the valve chamber 6 via the feed orifice 7. The inner container contains a first component A.

A return spring 13 is mounted between the end wall 2*a* and a lower end 10*b* of the nozzle, to urge the nozzle, at rest, into the valve closed position.

The inner container 4 is formed of a flexible pouch. Advantageously, this pouch includes a flexible sheet of plastic, made for example, of polyethylene or of a complex formed by a metal layer and at least one plastic layer. The end of the pouch is closed by a line of welding. Alternatively, the inner container 4 may be formed of a concertina or accordion-type container of contractible volume or any other similar appropriate container.

The valve body 2 is further provided with a second feed orifice 8 made in the lateral wall 2*b* of the valve body, and this being more or less over its upper portion. A fitting ring 16 is located on the valve body 2 so as to connect the second feed orifice 8 to a dip tube 20.

This dip tube extends more or less to the bottom 5*a* of the outer container, thus dipping, when the dispenser is in the head-up position, into the second component B.

Aside from the component B, the volume formed between the internal wall of the outer container 5 and the outer wall of the inner container 4, contains an appropriate amount of propellant gas (G).

The nozzle 10 comprises a radial passage 15*a* made in the stem 10*a* near its region that joins the portion 10*c* and leading towards the dispensing duct 15.

A fixed elastic washer 12 is mounted around this meeting zone above the portion 10*c*. It is immobilized between a portion of the valve-holder dish 9 and a projecting upper portion of the valve body 2. Thus, the radial passage 15*a* of the stem 10*a* is located, when the valve is in the position of rest, in the thickness of the fixed washer 12 and closed off thereby. When the valve is actuated, the passage 15*a* is shifted axially downwards, thus establishing communication between the valve chamber 6 and the outside.

Figure 3:
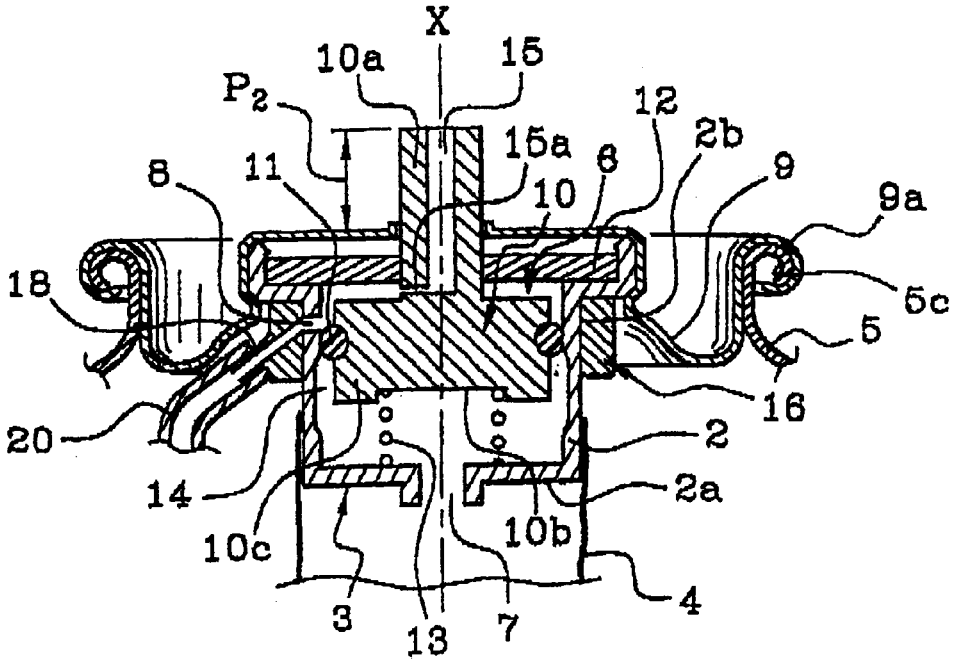
FIG. 3 is a cross-sectional view of the valve of FIG. 1*a*, depicted in the position of the dispensing of a second component alone.
Figure 4:
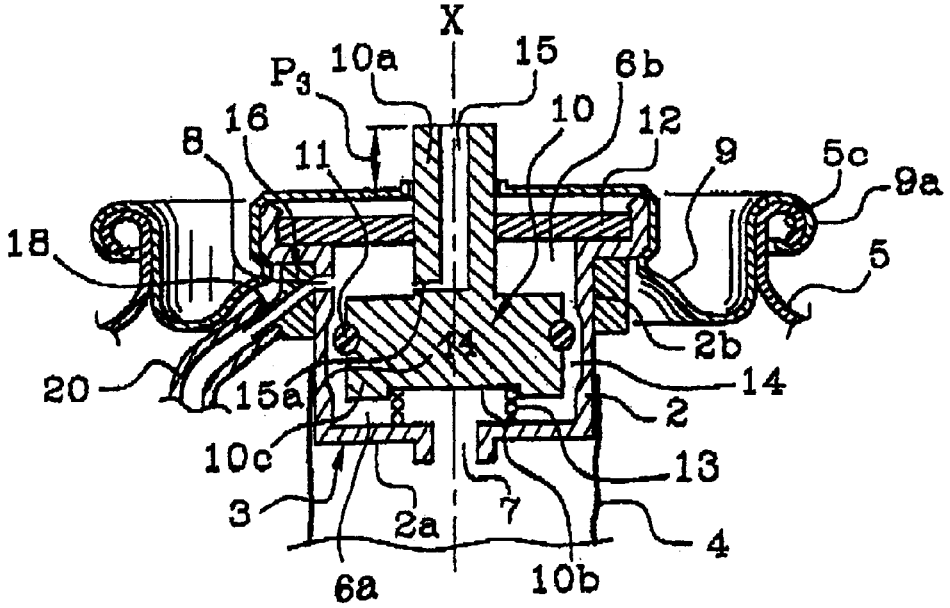
FIG. 4 is a cross-sectional view of the valve of FIG. 1*a*, depicted in the position of the dispensing of a mixture of the first and second components.

The annular seal or the bulge 11 divides the valve chamber 6 into two parts: a lower part 6*a* in communication with the first feed orifice 7, and an upper part 6*b* in communication with the second feed orifice 8 (see FIGS. 3 and 4).

The way in which the dispenser 1 works is as follows: in the position of rest, the valve 3 is closed, that is to say that the second feed orifice 8 is blocked by the moving seal 11. At the same time, the passage 15*a* is closed off by the fixed elastic washer 12. Thus, in the position of rest, the moving seal 11 provides a sealed division between the containers 4 and 5 so that the liquid B packaged in the outer container 5 cannot pass into the inner container 4 (FIG. 2) and vice versa. It is to be noted that the volume of the part 6*b* of the valve chamber 6 is, in this instance, practically zero.

Figure 2:
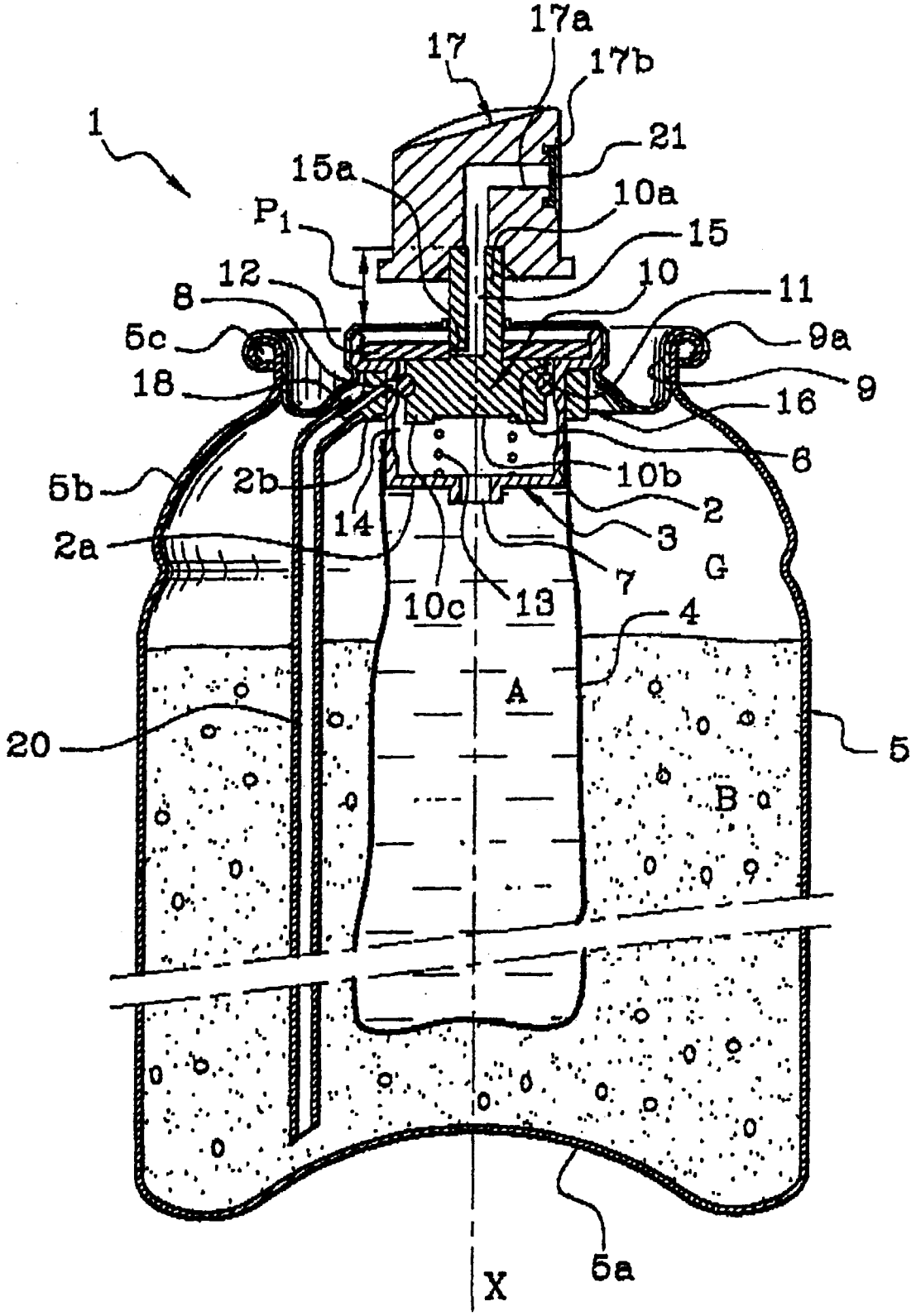
FIG. 2 is a partial cross-sectional view of the dispenser of FIG. 1*a*, the dispensing valve being depicted in the closed position.

The position of rest of the dispenser 1 is illustrated in FIG. 2, the free end of the valve stem 10*a* being located at a distance P, from the dish 9.

FIGS. 3 and 4 illustrate actuation of the valve 3 following partial depression (P2; FIG. 3) and full depression (P3; FIG. 4) of the actuator 10. For simplification purposes, the push-button 17 is not depicted in these figures.

To dispense a dose of component B alone, the user pushes slightly on the push-button 17 to cause the nozzle (acutator) 10 to move down partially. The nozzle 10 occupies an intermediate position P2 as shown in FIG. 3. In this position, the moving seal 11 uncovers the second feed orifice 8 while still separating the components A and B in the valve body. Note that the upper part of the valve chamber 6 here has a small volume. The radial duct 15*a* of the nozzle is uncovered, below the elastic washer 12. Under the pressure of the propellant gas G, the component B rises up the dip tube 20 and then, via the fitting ring 16, passes through the orifice 8. The component B ends up escaping through the dispensing nozzle element 21 via the valve chamber 6, the radial passage 15*a*, the dispensing duct 15 and the elbowed conveying duct 17*a*.

To dispense a mixture of components A and B, the user fully depresses the pushbutton so that the valve nozzle 10 is in the third position P3. It is fully depressed as illustrated in FIG. 4. In this position, the dip tube 20 still communicates with the valve chamber 6. At the same time, the passage 14 becomes operative. Specifically, it can be seen that the seal 11 is facing a zone 14 of the lateral wall 2*b* which has a larger internal cross section than the cross section of the remainder of the valve body 2. Thus, a "bypass" is formed, allowing component A to rise up from the first feed orifice 7 into the valve chamber 6. The rising of the component B is brought about by the pressure of the propellant gas G exerted on the deformable wall of the inner container 4, compressing it.

The mixing of the components A and B therefore takes place in the valve chamber 6 and more specifically in the upper part 6*b* located above the seal 11. This mixture is then conveyed towards the dispensing nozzle element 21 as described above. To ensure appropriate mixing of the components A and B, the upper part 6*b* of the valve chamber has a maximum volume (FIG. 4). When the push-button is released, under the action of the spring 13, the nozzle 10 returns to its initial position (FIG. 2) to close the valve 3.

Figure 1B:
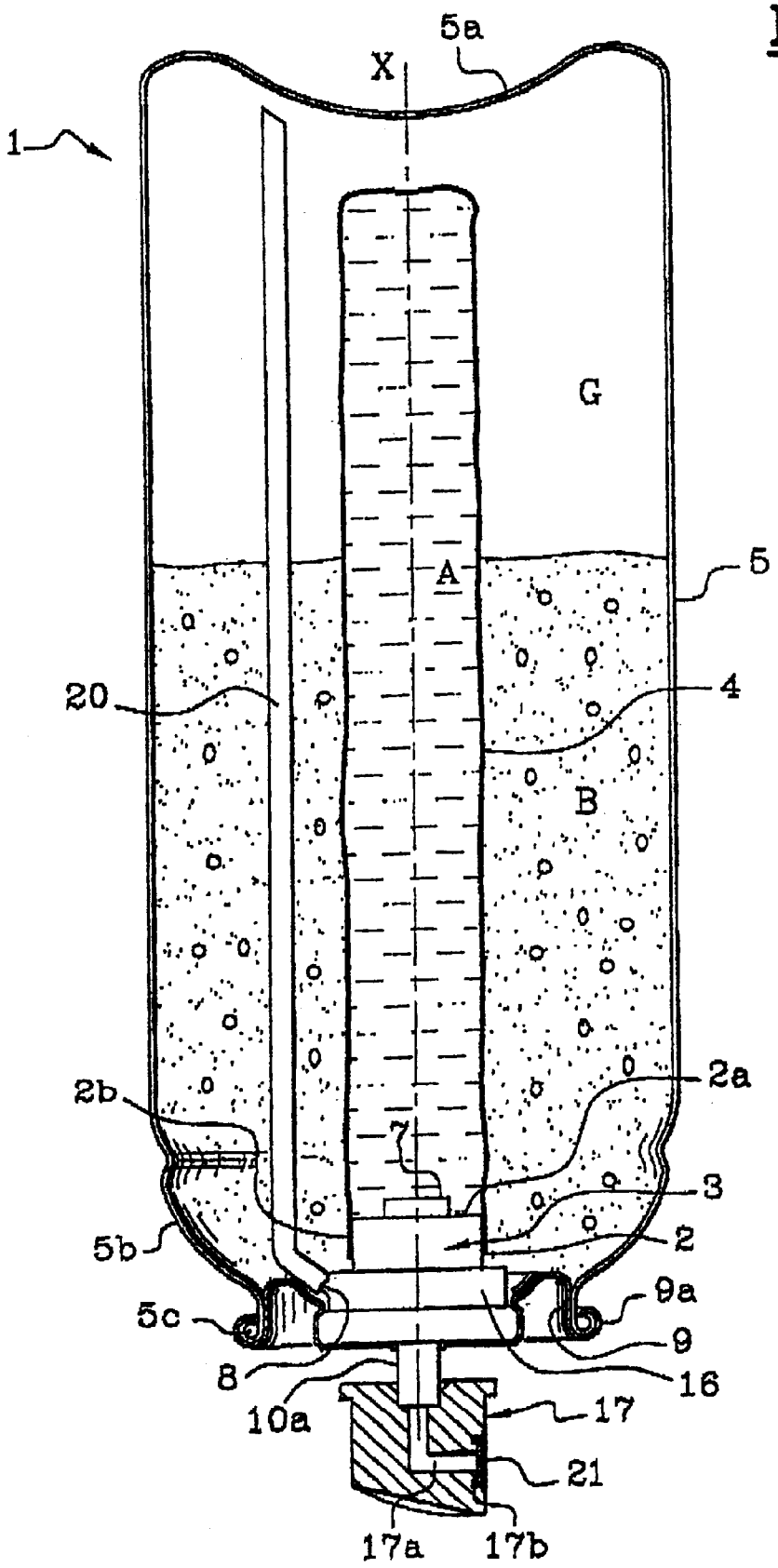

To dispense a dose of component A with added propellant gas, the user inverts the orientation of the dispenser 1, which then becomes "head down", as illustrated in FIG. 1*b*. In this position, the dip tube 20 communicates directly with the gaseous phase G located at the top of the outer container 5. The propellant gas G indirectly pressurizes the component A in the inner container 4 by compressing it. By depressing the push-button fully, the user thus dispenses a mixture of gas and of component A, which is formed beforehand in the valve chamber 6. Under these conditions, the nozzle 10 occupies the position P3 shown in FIG. 4. Note that the combination of propellant gas with component A, if the component A is fluid enough, makes it possible to form a spray of particularly fine droplets formed at the outlet of the dispenser nozzle element 21.

To clean out the dispensing path (the upper part 6*b* of the valve chamber 6, the passage 15*a*, the dispensing duct 15, the conveying duct 17*a* and the nozzle element 21) after at least one component has been dispensed, in the "head-down" position, the user pushes the actuator 10 partially in. Thus, a stream of pressurized pure gas rids the dispensing path of any product residue. Note that this thus avoids the component A being in prolonged contact with component B in the valve chamber 6, which is advantageous when the two components have a tendency to clump together over time. As mentioned earlier, the upper part of the valve chamber 6 here has a small volume making it possible, once a dose of product has been dispensed, to minimize the amount of product remaining therein.

Figure 5:
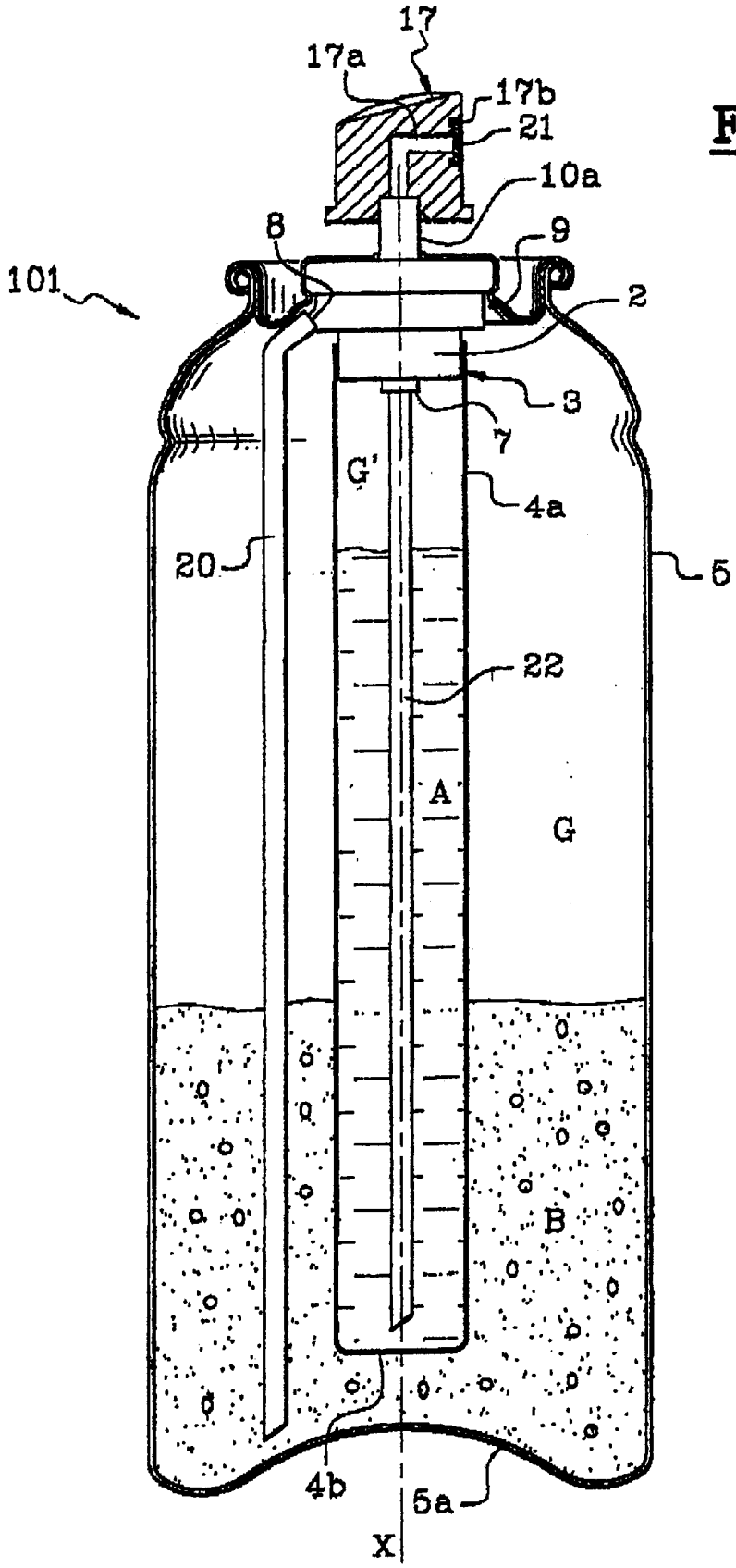
FIG. 5 is a cross-sectional view of another embodiment of the dispenser according to invention.

According to another embodiment, a dispenser 101, as illustrated in FIG. 5, has the same structure as the dispenser 1 described earlier except that the inner container 4*a* is rigid. It cannot be deformed by the propellant gas G packaged together with the component B in the outer container 5. The inner container 4*a* contains the component A, which is pressurized directly with a propellant gas G' packaged in the same inner container 4*a*. Furthermore, a second dip tube 22 is provided, this being connected to the feed orifice 7 of the valve, and running down more or less to the bottom 4*b* of the inner container 4.

The dispenser 101 is designed for "head-up" use exclusively to disperse the components. According to a first embodiment, the dispenser 101 allows component B to be dispensed by itself. This can be achieved by partially depressing the push-button 17 to position P2.

According to a second mode of use, by fully depressing the push-button 17 to the position P3, a mixture of components A and B can be dispensed.

Component A cannot be dispensed by itself according to this embodiment of the dispenser 101.

To clean out the dispensing path (the upper part of the valve chamber 6, the passage 15*a*, the dispensing duct 15, the conveying duct 17*a* and the nozzle element 21) after at least one component has been dispensed, holding the container the "head-down" position, the user depresses the actuator 10 either partially or fully. Thus, a stream of pressurized pure gas rids the dispensing path of any product residue. Note that by depressing the actuator partially, substantially only the gas G contained in the outer vessel is conveyed through the dispensing. By depressing the actuator fully, a mixture of gas G contained in the outer vessel 5 with gas G' contained in the inner container 4*a* is conveyed through the dispensing path.

Figure 6:
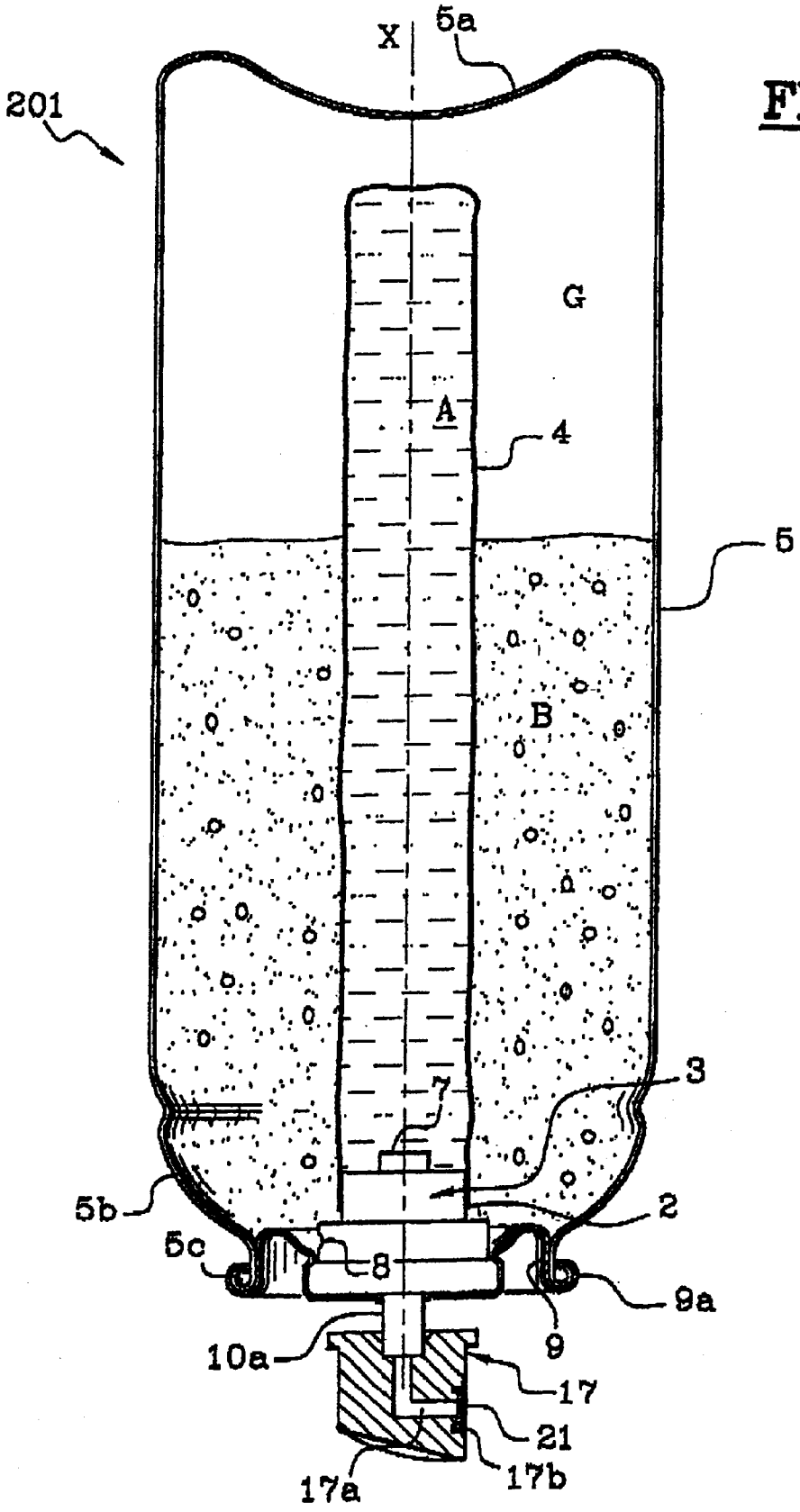
FIG. 6 is a cross-sectional view of yet another embodiment of the dispenser according to invention.

FIG. 6 illustrates, according to yet another embodiment, a dispenser 201. The dispenser 201 has more or less the same structure as the dispenser 1 described earlier except that it has no dip tube and that it is operated the other way up by comparison with the dispenser 1. In other words, in the "head-down" orientation, as shown in FIG. 6, when the push-button 17 is depressed partially in (P2), the valve 3 is in the position shown in FIG. 3. Under the thrust of the propellant gas G, substantially only the component B is conveyed to the dispensing orifice 21.

When, in the "head-down" position, the push button is fully depressed, the nozzle 10 is at the end of its travel and occupies the position P3 shown in FIG. 4. The two feed orifices 7 and 8 are then in communication with the dispensing orifice 21. The compression of the inner container 4 by the propellant gas G, and the thrust exerted thereby on the component B, cause the components A and B to be conveyed towards the valve chamber 6 (FIG. 4). They are mixed in the valve chamber 6 and the mixture is then conveyed to the dispensing orifice 21 via the routes described above.

When the user wishes to dispense some of component A alone (or more precisely a mixture of propellant gas G and component A), he inverts the dispenser 201 into the "head-up" position. In this position, the first feed orifice 7 of the valve is in communication with the component A, itself pressurized by compression of the inner container 4 by the propellant gas G. In this "head-up" position, the gaseous phase G is also in communication with the second feed orifice 8. By depressing the push-button 17 into the position P3 in accordance with the diagram that is FIG. 4, the two feed orifices 7, 8 both communicate with the dispensing orifice 21. A mixture of component A and propellant G can thus be dispensed, something which is advantageous if there is a desire to obtain a spray of fine droplets.

To clean out the dispensing path (the upper part of the valve chamber 6, the passage 15*a*, the dispensing duct 15, the conveying duct 17*a* and the nozzle element 21) after at least one component has been dispensed, with the container in the "head-up" position, the user partially depresses the actuator 10. Thus, a stream of pressurized pure gas rids the dispensing path of any product residue.

There are various possible ways of filling with propellant gas G. In the case of a dispenser according to FIGS. 1*a,* 1*b* and 6, the propellant gas is introduced via the valve 2 in the conventional way by a filling rod arranged in a sealed fashion over the valve dish 9. Alternatively, a filling valve (not depicted) is mounted in the bottom 5*a* of the outer container 5. Thus, in both instances, the propellant gas G is only in the outer container 5. Thus, this propellant gas is in direct contact with only the second component B. At the same time, the propellant gas exerts pressure on the inner pouch 4, pressurizing the first component A indirectly.

In the case of the dispenser according to FIG. 5, the propellant gas G is introduced via the nozzle 10*a* in the fully depressed position. Thus, the propellant gas enters and spreads out in both compartments 4*a* and 5.

It is to be clearly understood that when the propellant is soluble in one of the components, the dispenser according to the invention can be used for selective dispensing of one of the components alone or of a mixture of the two components, in the form of a mousse or foam.

What is claimed is:

1. A dispenser for selectively dispensing at least two components, singularly and in combination, comprising:

an outer container and an inner container arranged inside the outer container;

a first component contained in the inner container and a second component separated from the first component and contained in the outer container;

a gas propellant contained in at least the outer container;

a dispensing valve having a body configured to be placed in selective communication with at least one of said inner and outer containers so as to dispense at least one of said first component, second component, and gas propellant via a dispensing path; and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components.

2. The dispenser of claim 1, wherein the dispensing valve is configured to be placed in communication with said inner container via a first feed orifice.

3. The dispenser of claim 1, wherein the dispensing valve is configured to be placed in communication with said outer container via a second feed orifice.

4. The dispenser of claim 1, wherein the dispensing valve is configured to be placed in communication with said inner and outer containers via first and second feed orifices, respectively.

5. The dispenser of claim 1, wherein the valve actuator includes an elastic seal.

6. The dispenser of claim 5, wherein the elastic seal divides an inner chamber of the valve into an upper part and a lower part.

7. The dispenser of claim 6, wherein the lower part of the valve chamber is in communication with a first feed orifice and the upper part of the inner chamber is in communication with a second feed orifice.

8. The dispenser of claim 7, wherein the dispensing valve body includes an internal groove forming a passage between the upper and lower parts of the inner chamber when the actuator is in the second actuation position.

9. The dispenser of claim 1, wherein the inner container is compressible.

10. The dispenser of claim 1, wherein the inner container includes a flexible pouch configured to be compressed in response to pressure exerted by the propellant gas contained in the outside container.

11. The dispenser of claim 1, wherein the dispensing valve has a single body defining an inner chamber.

12. The dispenser of claim 11, wherein the valve actuator is movable between a position of rest, in which the inner chamber is isolated from the outside, and the first and second actuation positions.

13. The dispenser of claim 11, wherein, when the actuator is in the first actuated position the inner chamber is in communication with a first feed orifice.

14. The dispenser of claim 11, wherein when the actuator is in the second actuated position, the inner chamber is in communication with first and second feed orifices.

15. The dispenser of claim 13, wherein the first feed orifice is in communication with the inner container.

16. The dispenser of claim 14, wherein the first feed orifice is in communication with the inner container.

17. The dispenser of claim 14, wherein the second feed orifice is in communication with the outer container.

18. The dispenser of claim 1, wherein, when the actuator is partially depressed, it is in the first actuated position.

19. The dispenser of claim 1, wherein, when the actuator is fully depressed, it is in the second actuated position.

20. The dispenser of claim 1, wherein the inner container is in communication with a first feed orifice.

21. The dispenser of claim 20, wherein the outer container is in communication with a second feed orifice.

22. The dispenser of claim 21, wherein the second feed orifice is connected to a dip tube in the outer container.

23. The dispenser of claim 1, wherein the inner container is rigid.

24. The dispenser of claim 23, wherein the inner container further contains a propellant gas.

25. The dispenser of claim 24, wherein the inner container further includes a dip tube.

26. The dispenser of claim 20, wherein the first orifice is connected to a dip tube in the inner container.

27. The dispenser of claim 1, wherein the dispenser is movable between a head-up dispensing position and a head-down dispensing position.

28. The dispenser of claim 27, wherein, when the dispenser is in the head-up dispensing position and the actuator is in the first actuation position, the dispenser is configured to dispense the second component and gas propellant from the outer container.

29. The dispenser of claim 27, wherein, when the dispenser is in the head-up dispensing position and the actuator is in the first actuation position, the dispenser is configured to dispense substantially only the gas propellant from the outer container.

30. The dispenser of claim 27, wherein, when the dispenser is in the head-down dispensing position and the actuator is in the first actuation position, the dispenser is configured to dispense substantially only the gas propellant from the outer container.

31. The dispenser of claim 27, wherein, when the dispenser is in the head-down dispensing position and the actuator is in the first actuation position, the dispenser is configured to dispense substantially only the second component from the outer container.

32. The dispenser of claim 27, wherein when the dispenser is in the head-up dispensing position and the actuator is in the second actuation position, the dispenser is configured to dispense the first component from the inner container and the second component and gas propellant from the outer container.

33. The dispenser of claim 27, wherein when the dispenser is in the head-up dispensing position and the actuator is in the second actuation position, the dispenser is configured to dispense the first component from the inner container and substantially only gas propellant from the outer container.

34. The dispenser of claim 27, wherein the inner container also contains a gas propellant.

35. The dispenser of claim 34, wherein when the dispenser is in the head-up dispensing position and the actuator is in the second actuation position, the dispenser is configured to dispense the first component and gas propellant from the inner container and the second component and gas propellant from the outer container.

36. The dispenser of claim 34, wherein when the dispenser is in the head-down dispensing position and the actuator is in the second actuation position, the dispenser is configured to dispense substantially only gas propellant from the inner container and substantially only gas propellant from the outer container.

37. The dispenser of claim 27, wherein when the dispenser is in the head-down dispensing position and the actuator is in the second actuation position, the dispenser is configured to dispense the first component from the inner container and substantially only gas propellant from the outer container.

38. The dispenser of claim 27, wherein when the dispenser is in the head-down dispensing position and the actuator is in the second actuation position, the dispenser is configured to dispense the first component from the inner container and only the second component from the outer container.

39. A method for selectively dispensing components contained in a dispenser, comprising:

providing a dispenser comprising an outer container and an inner container arranged inside the outer container, a first component contained in the inner container and a second component separated from the first component and contained in the outer container, a gas propellant contained in at least the outer container, a dispensing valve having a body configured to be placed in selective communication with at least one of said inner and outer containers so as to dispense at least one of said first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components;

holding the dispenser in a head-up dispensing position; and depressing the actuator to the first actuation position to dispense the second component and gas propellant from the outer container.

40. A method for selectively dispensing components contained in a dispenser, comprising:

providing a dispenser comprising an outer container and an inner container arranged inside the outer container, a first component contained in the inner container and a second component separated from the first component and contained in the outer container, a gas propellant contained in at least the outer container, a dispensing valve having a body configured to be placed in selective communication with at least one of said inner and outer containers so as to dispense at least one of said first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components;

holding the dispenser in a head-up dispensing position; and depressing the actuator to the first actuation position to dispense substantially only the gas propellant from the outer container.

41. A method for selectively dispensing components contained in a dispenser, comprising:

providing a dispenser comprising an outer container and an inner container arranged inside the outer container, a first component contained in the inner container and a second component separated from the first component and contained in the outer container, a gas propellant contained in at least the outer container, a dispensing valve having a body configured to be placed in selective communication with at least one of said inner and outer containers so as to dispense at least one of said first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components;

holding the dispenser in a head-down dispensing position; and depressing the actuator to the first actuation position to dispense substantially only the gas propellant from the outer container.

42. A method for selectively dispensing components contained in a dispenser, comprising:

providing a dispenser comprising an outer container and an inner container arranged inside the outer container, a first component contained in the inner container and a second component separated from the first component and contained in the outer container, a gas propellant contained in at least the outer container, a dispensing valve having a body configured to be placed in selective communication with at least one of said inner and outer containers so as to dispense at least one of said first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components;

holding the dispenser in a head-down dispensing position; and depressing the actuator to the first actuation position to dispense substantially only the second component from the outer container.

43. A method for selectively dispensing components, comprising:

providing a dispenser comprising an outer container and an inner container arranged inside the outer container, a first component contained in the inner container and a second component separated from the first component and contained in the outer container, a gas propellant contained in at least the outer container, a dispensing valve having a body configured to be placed in selective communication with at least one of said inner and outer containers so as to dispense at least one of said first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components;

holding the dispenser in a head-up dispensing position; and depressing the actuator to the second actuation position to dispense the first component from the inner container and the second component and gas propellant from the outer container.

44. A method for selectively dispensing components, comprising:

providing a dispenser comprising an outer container and an inner container arranged inside the outer container, a first component contained in the inner container and a second component separated from the first component and contained in the outer container, a gas propellant contained in at least the outer container, a dispensing valve having a body configured to be placed in selective communication with at least one of said inner and outer containers so as to dispense at least one of said first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components;

holding the dispenser in a head-up dispensing position; and depressing the actuator to the second actuation position to dispense the first component from the inner container and substantially only gas propellant from the outer container.

45. A method for selectively dispensing components, comprising:

providing a dispenser comprising an outer container and an inner container arranged inside the outer container, a first component contained in the inner container and a second component separated from the first component and contained in the outer container, a gas propellant contained in the inner and outer containers, a dispensing valve having a body configured to be placed in selective communication with at least one of said inner and outer containers so as to dispense at least one of said first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components;

holding the dispenser in a head-up dispensing position; and depressing the actuator to the second actuation position to dispense the first component and gas propellant from the inner container and second component and gas propellant from the outer container.

46. A method for selectively dispensing components, comprising:

providing a dispenser comprising an outer container and an inner container arranged inside the outer container, a first component contained in the inner container and a second component separated from the first component and contained in the outer container, a gas propellant contained in the inner and outer containers, a dispensing valve having a body configured to be placed in selective communication with at least one of said inner and outer containers so as to dispense at least one of said first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components;

holding the dispenser in a head-down dispensing position; and depressing the actuator to the second actuation position to dispense substantially only gas propellant from the inner container and substantially only gas propellant from the outer container.

47. A method for selectively dispensing components, comprising:

providing a dispenser comprising an outer container and an inner container arranged inside the outer container, a first component contained in the inner container and a second component separated from the first component and contained in the outer container, a gas propellant contained in at least the outer container, a dispensing valve having a body configured to be placed in selective communication with at least one of said inner and outer containers so as to dispense at least one of said first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components;

holding the dispenser in a head-down dispensing position; and depressing the actuator to the second actuation position to dispense the first component from the inner container and substantially only gas propellant from the outer container.

48. A method for selectively dispensing components, comprising:

providing a dispenser comprising an outer container and an inner container arranged inside the outer container, a first component contained in the inner container and a second component separated from the first component and contained in the outer container, a gas propellant contained in at least the outer container, a dispensing valve having a body configured to be placed in selective communication with at least one of said inner and outer containers so as to dispense at least one of said first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components; holding the dispenser in a head-down dispensing position; and depressing the actuator to the second actuation position to dispense the first component from the inner container and substantially only the second component from the outer container.

49. A method of cleaning out a dispensing path of a dispenser comprising:

providing a dispenser comprising an outer container and an inner container arranged inside the outer container, a first component contained in the inner container and a second component separated from the first component and contained in the outer container, a gas propellant contained in at least the outer container, a dispensing valve having a body configured to be placed in selective communication with at least one of said inner and outer containers so as to dispense at least one of said first component, second component, and gas propellant via a dispensing path, and a valve actuator having a first actuation position and a second actuation position, wherein, when the actuator is in the first position, the dispenser is capable of dispensing substantially only gas propellant to clean out the dispensing path, and when the actuator is in the second position, the dispenser is capable of dispensing a mix of the first and second components;

orienting the dispenser to provide communication between the gas in the outer container and a second feed orifice; and depressing the actuator to provide communication between the second feed orifice and the dispensing path to dispense substantially only gas from the outer container.

50. The dispenser of claim 5, wherein the elastic seal is an annular seal.

51. The dispenser of claim 5, wherein the elastic seal is an O-ring.

52. The dispenser of claim 5, wherein the elastic seal is a cylindrical bulge integrally molded with the valve actuator.

53. The dispenser of claim 1, wherein the first and second components are chosen from the following pairs of components: two different scents, a sunscreen and an after-sun product, two hair colorants of different shades, two vitamins, two cosmetic products, two products having dermo-pharmaceutical active ingredients, a foundation and a moisturizer, a deodorant and antiperspirant, a hair conditioner and a coating, a permanent wave including a reducing component and a fixing component, a hair dye including an oxidizing agent and a colorant, and a two-part adhesive including a monomer and a catalyst.

54. The method of claim 39, wherein the first and second components are chosen from the following pairs of components: two different scents, a sunscreen and an after-sun product, two hair colorants of different shades, two vitamins, two cosmetic products, two products having dermo-pharmaceutical active ingredients, a foundation and a moisturizer, a deodorant and antiperspirant, a hair conditioner and a coating, a permanent wave including a reducing component and a fixing component, a hair dye including an oxidizing agent and a colorant, and a two-part adhesive including a monomer and a catalyst.

55. The method of claim 42, wherein the first and second components are chosen from the following pairs of components: two different scents, a sunscreen and an after-sun product, two hair colorants of different shades, two vitamins, two cosmetic products, two products having dermo-pharmaceutical active ingredients, a foundation and a moisturizer, a deodorant and antiperspirant, a hair conditioner and a coating, a permanent wave including a reducing component and a fixing component, a hair dye including an oxidizing agent and a colorant, and a two-part adhesive including a monomer and a catalyst.

56. The method of claim 43, wherein the first and second components are chosen from the following pairs of components: two different scents, a sunscreen and an after-sun product, two hair colorants of different shades, two vitamins, two cosmetic products, two products having dermo-pharmaceutical active ingredients, a foundation and a moisturizer, a deodorant and antiperspirant, a hair conditioner and a coating, a permanent wave including a reducing component and a fixing component, a hair dye including an oxidizing agent and a colorant, and a two-part adhesive including a monomer and a catalyst.

* * * * *